US005887418A

United States Patent [19]

Brückner et al.

[11] Patent Number: 5,887,418

[45] Date of Patent: Mar. 30, 1999

[54] METHOD FOR OPERATING A GAS-TURBINE AND STEAM-TURBINE PLANT AND PLANT WORKING ACCORDING TO THE METHOD

[75] Inventors: Hermann Brückner, Uttenreuth; Erich Schmid, Marloffstein, both of Germany

[73] Assignee: Siemens Aktiengesellschaft, Munich, Germany

[21] Appl. No.: 826,240

[22] Filed: Mar. 27, 1997

Related U.S. Application Data

[63] Continuation of PCT/DE95/01263, Sep. 14, 1995.

[30] Foreign Application Priority Data

Sep. 27, 1994 [DE] Germany ..... 44 34 526.7

[51] Int. Cl.[6] ..... F02C 6/18

[52] U.S. Cl. ..... 60/39.02; 60/39.182

[58] Field of Search ..... 60/39.02, 39.07, 60/39.182; 122/7 B

[56] References Cited

U.S. PATENT DOCUMENTS

| | | | |
|---|---|---|---|
| 4,852,344 | 8/1989 | Warner . | |
| 5,365,730 | 11/1994 | Bruckner et al. | 60/39.182 |
| 5,628,183 | 5/1997 | Rice | 60/39.182 |

FOREIGN PATENT DOCUMENTS

| | | |
|---|---|---|
| 3815536C1 | 7/1989 | Germany . |
| 4126036A1 | 2/1993 | Germany . |

OTHER PUBLICATIONS

Patent Abstracts of Japan No. 04362207 (Nobuo), dated Dec. 15, 1992.

*Primary Examiner*—Louis J. Casaregola

*Attorney, Agent, or Firm*—Herbert L. Lerner; Laurence A. Greenberg

[57] ABSTRACT

A method for operating a gas-turbine and steam-turbine plant and a plant working according to the method, utilize exhaust gas from a gas turbine for steam generation when the plant is in operation. In order to ensure that a gas-turbine model can be freely selected, irrespective of its power rating and with a reduction in exhaust gas losses, in the case of both a new plant and a retrofitting of an already existing plant, a first part stream of exhaust gas from the gas turbine is used as combustion air for the combustion of a fossil fuel and a second part stream of exhaust gas from the gas turbine is utilized for waste-heat steam generation. At the same time, for steam generation, a combination of a fossil-fired steam generator and a waste-heat steam generator is located downstream of the gas turbine on the exhaust gas side, in each case through a part-stream conduit. The steam generation by the combustion of the fossil fuel and the waste-heat steam generation take place in a common water/steam circuit of the steam turbine.

8 Claims, 1 Drawing Sheet

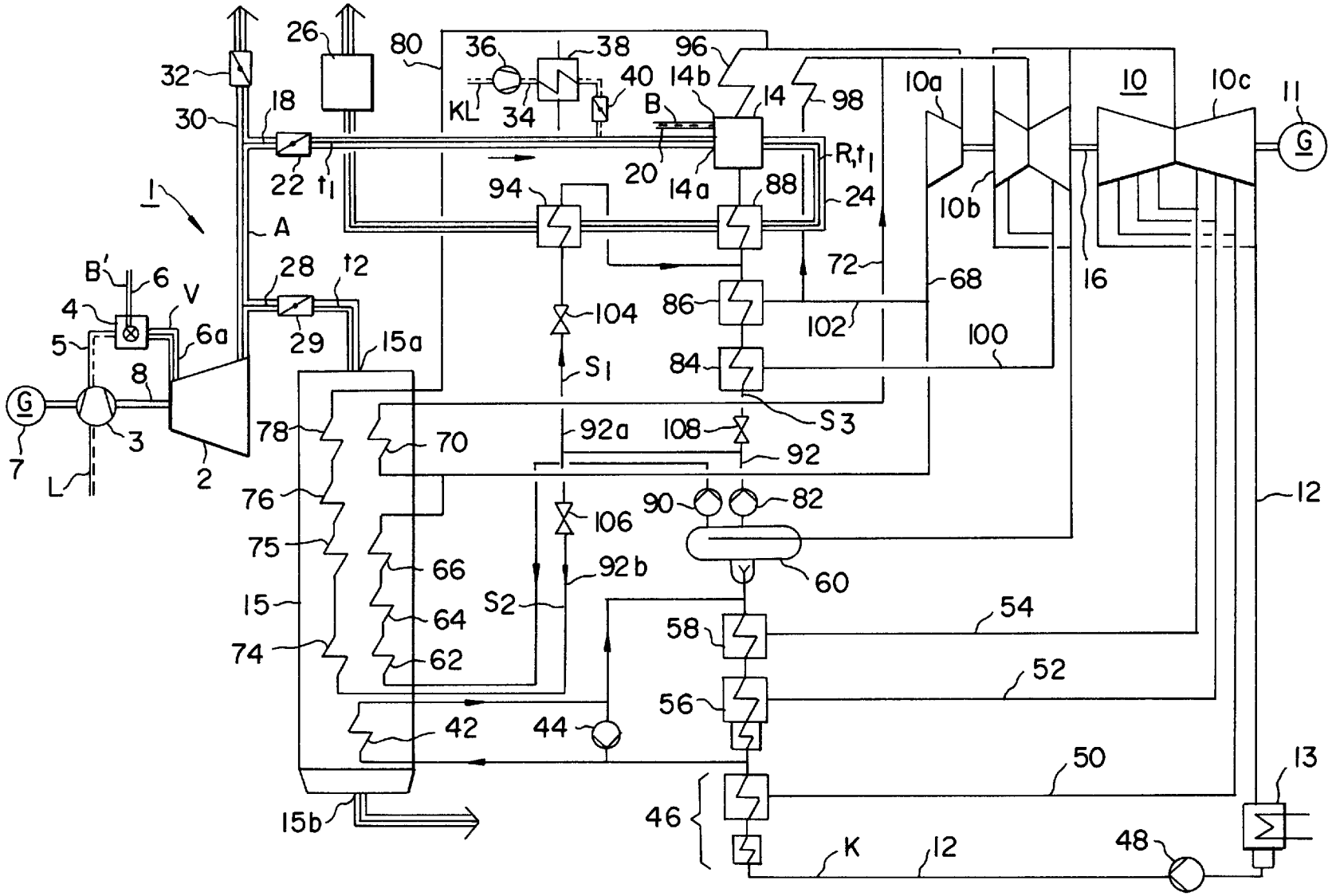
G
11
10c
10
10b
10a
16
12
13
48
50
52
54
100
68
72
102
24
98
R,t1
14
88
96
14b
14a
B
20
40
38
34
36
KL
80
26
18
22
A
30
32
1
S3
92
82
60
108
90
86
84
58
56
46
K
104
S1
92a
106
92b
44
S2
94
70
66
64
62
42
15a
t2
28
29
78
76
75
15
74
15b
2
6a
V
6
B'
8
3
4
5
L
7

METHOD FOR OPERATING A GAS-TURBINE AND STEAM-TURBINE PLANT AND PLANT WORKING ACCORDING TO THE METHOD

CROSS-REFERENCE TO RELATED APPLICATION

This application is a Continuation of International Application No. PCT/DE95/01263, filed Sep. 14, 1995.

BACKGROUND OF THE INVENTION

FIELD OF THE INVENTION

The invention relates to a method for operating a gas-turbine and steam-turbine plant, in which oxygenous gas from a gas turbine is utilized for steam generation, a first part stream of exhaust gas from the gas turbine is used as combustion air for the combustion of a fossil fuel, a second part stream of exhaust gas from the gas turbine is utilized for waste-heat-steam generation, the steam generation by the combustion of the fossil fuel and the waste-heat steam generation take place in a common water/steam circuit of the steam turbine, and feedwater of the water/steam circuit is preheated in part streams.

The invention also relates to a gas-turbine and steam-turbine plant working according to the method, including a fossil fired steam generator which is connected into a water/steam circuit of a steam turbine and to which a waste-heat steam generator is connected in parallel on the water/steam side, both the fired steam generator, through a first part-stream conduit, and the waste-heat steam generator, through a second part-stream conduit, are connected downstream of the gas turbine on the exhaust gas side.

Such a method and such a plant are known from German Patent DE 38 15 536 C1 and U.S. Pat. No. 4,852,344.

In the combination of a steam-turbine process and a gas-turbine process, there are in principle two possibilities for utilizing the exhaust gas from the gas turbine for steam generation. As is described in the paper entitled "Kombinierte Gas-/Dampfturbinenprozesse" [Combined Gas-/Steam-Turbine Processes] in Brennstoff-Warme-Kraft [Fuel/Heat/Power] 31 (1979), No. 5, May, in a possible combined process with a downstream steam generator, the oxygen-rich exhaust gases of the gas turbine serve as combustion air for the fossil-fired steam generator. In another combined process with a downstream waste-heat steam generator, the gas-turbine and steam-turbine processes are combined by utilizing the waste heat of the gas turbine in the waste-heat steam generator. A gas-turbine and steam-turbine power station with a waste-heat steam generator and a solar-heated steam generator and with a fossil-heated heat exchanger downstream of an additional combustion chamber, is known from German Published, Non-Prosecuted Patent Application DE-OS 41 26 036.

In a combined process, the powers of the steam turbine and gas turbine and of the fired steam generator are dependent- on one another, so that when a plant of that type is constructed, they have to be coordinated with one another. That applies not only to a retrofitting of an already existing steam-turbine plant, but also to a new plant. The coordination is usually carried out in such a way that, in the nominal load operating mode, the oxygen requirement of the fired steam generator can be covered by the exhaust gases of the gas turbine. However, gas turbines with only a few different power ratings, for example with 50 MW, 150 MW or 200 MW, are manufactured and offered, so that it is extremely difficult to adapt them to the power of the steam turbine and to that of the steam generator. Consequently, for a predetermined plant size, in the full-load range the gas turbine supplies either too large or too small an exhaust-gas quantity in comparison with the exhaust-gas quantity required as combustion air for the fired steam generator. If the exhaust-gas quantity is too small, only a low efficiency of the plant is to be achieved in the full-load range, and that then becomes better in the part-load range.

In contrast, the result of too large an exhaust gas quantity from the gas turbine can be that, in a combined process in which the excess exhaust gases from the gas turbine are guided past a combustion chamber of the fired steam generator to a boiler preheater or feedwater preheater (economizer), the latter already experiences evaporation in an undesirable way due to the excessively high introduction of heat. Or, if there is too large an exhaust-gas quantity in the part-load range, the power of the gas turbine already has to be reduced at an early moment. However, with an increasing reduction in the power of the gas turbine, the efficiency of the plant in the part-load range decreases. In other words, in both cases, the overall efficiency that is achieved is limited. Therefore, particularly during the retrofitting of an already existing steam-turbine plant, a power increase arising from the gas turbine has to be dispensed with if the exhaust-gas heat of the gas turbine cannot be fully utilized or an acceptable part-load behavior cannot be obtained.

In contrast to the combined process with a downstream fired steam generator, the combined process with a downstream waste-heat steam generator is particularly suitable for the retrofitting of an already existing gas-turbine plant. In the case of a new plant, usually a number of gas turbines having a corresponding number of waste-heat steam generators are connected to a common steam turbine. Since, in that combined process, the steam generation is restricted to a pure waste-heat utilization, the overall efficiency of the plant is likewise limited. Furthermore, in that combined process as well, there is the problem of finding a suitable gas-turbine model in the event of a necessary or desired exchange of the gas turbine for a gas turbine of comparatively high power. That is because, for a predetermined power of the steam turbine and consequently a predetermined rating of the waste-heat steam generator, the introduction of heat through the use of the exhaust gas from a comparatively large gas turbine into the waste-heat steam generator would be too high, so that, particularly in preheaters (economizers) disposed within the steam generator, evaporation would already take place in an undesirable way.

SUMMARY OF THE INVENTION

It is accordingly an object of the invention to provide a method for operating a gas-turbine and steam-turbine plant and a plant working according to the method, which overcome the hereinafore-mentioned disadvantages of the heretofore-known methods and devices of this general type, in which the method simultaneously permits the use of a gas turbine freely selectable from a multiplicity of gas turbines of differing power rating with a particularly high overall efficiency of the plant and in which the plant uses particularly simple provisions.

With the foregoing and other objects in view there is provided, in accordance with the invention, a method for operating a gas-turbine and steam-turbine plant, which comprises directing a first part stream of oxygenous exhaust gas from a gas turbine for use as combustion air for combustion of a fossil fuel for steam generation; directing a second part stream of the exhaust gas from the gas turbine for use in waste-heat-steam generation; performing the fossil fuel combustion steam generation and the waste-heat steam generation in a common water/steam circuit of a steam turbine; preheating a first part stream of feedwater of the water/steam circuit with flue gas occurring during the combustion of the fossil fuel; preheating a second part stream of the feedwater of the water/steam circuit with the second part stream of the exhaust gas from the gas turbine; and preheating a third part stream of the feedwater of the water/steam circuit with steam from the steam turbine.

In order to provide steam generation, a first part stream of exhaust gas from the gas turbine is used for the combustion of a fossil fuel. A second part stream of exhaust gas from the gas turbine is utilized for waste-heat steam generation, and at the same time, both the steam generation due to the combustion of the fossil fuel and the waste-heat steam generation take place in a common water/steam circuit of the steam turbine. Thus, the feedwater of the water/steam circuit, which feedwater is advantageously under high pressure, is preheated in part streams, in which the preheating of the first part stream of feedwater takes place through the use of flue gas occurring during the combustion of the fossil fuel. The preheating of the second part stream of feedwater takes place through the use of the second part stream of exhaust gas from the gas turbine, with the second part stream flowing through the waste-heat steam generator. The third part stream of feedwater is preheated through the use of tapped steam from the steam turbine.

In accordance with another mode of the invention, the preheating of the three part streams of feedwater takes place in a multi-stage manner, with the preheating of the first part stream and of the third part stream taking place in a second preheating stage common to these through the use of the flue gas occurring during the combustion of the fossil fuel.

The invention proceeds from the consideration that, as a result of the combination of pure waste-heat utilization and utilization as combustion air, a division of these types of utilization of the exhaust gas from the gas turbine can, irrespective of its power rating, be coordinated in the best possible way with regard to the overall efficiency of the plant, if in addition the residual heat which is contained in the exhaust gas from the gas turbine and in the flue gas occurring during the combustion of the fossil fuel and which can no longer be utilized for steam generation, is expediently used for feedwater preheating.

A wide range of fuels can advantageously be employed in the fired steam generator. Thus, for example, oil, gas, coal or special fuels, such as, for example, refuse, wood or waste oil, can be used as fossil fuel. In the use of, for example, coal as fuel for the fired steam generator, the exhaust-gas temperature downstream of the gas turbine of approximately 500° is, under some circumstances, too high for coal drying. Therefore, in accordance with a further mode of the invention, a cold-air stream is admixed with the first part stream of exhaust gas from the gas turbine serving as combustion air.

The still oxygenous exhaust gas from the gas turbine with an oxygen content of, for example, 15% serves as the only combustion air for the fossil fuels to be burnt in the fired steam generator, and the fired steam generator is expediently loaded only with the exhaust-gas quantity necessary for combustion. A flue gas purification system, provided where appropriate, must therefore be constructed only for the first part stream of exhaust gas from the gas turbine and not for the entire exhaust-gas quantity. Therefore, in accordance with an added mode of the invention, the first part stream of exhaust gas from the gas turbine serving as combustion air is purified together with the flue gas occurring during the combustion of the fossil fuel.

With the objects of the invention in view, there is also provided a gas-turbine and steam-turbine plant, comprising a gas turbine having an exhaust gas side; first and second part-stream conduits connected to the exhaust gas side of the gas turbine; a steam turbine; a water/steam circuit connected to the steam turbine; a fossil fired steam generator connected to the first part-stream conduit downstream of the gas turbine, the fired steam generator having a water/steam side connected into the water/steam circuit; a waste-heat steam generator connected to the second part-stream conduit downstream of the gas turbine, the waste-heat steam generator connected parallel to the fired steam generator on the water/steam side; and a number of preheaters for multistage preheating of feedwater for the fired steam generator and for the waste-heat steam generator.

A fossil-fired steam generator is inserted into the water/steam circuit of the steam turbine, and a waste-heat steam generator is connected in parallel to it on the water/steam side. Both the fired steam generator, through a first part-stream conduit, and the waste-heat steam generator, through a second part-stream conduit, are located downstream of the gas turbine on the exhaust-gas side. The preheating of the feedwater is carried out in multiple stages, for both steam generators.

In accordance with another feature of the invention, there is provided a flue-gas purification system located downstream of the fired steam generator on the flue-gas side. Since the flue-gas purification system has to be constructed only for the first part stream of exhaust gas from the gas turbine and for the flue-gas quantity generated in the fossil-fired steam generator, problems regarding a necessary limitation of the size of the purification system for reasons of space do not arise in the case of either a new plant or a retrofitting of an old plant. An undesirable reduction in the steam-generator power in the case of a purification system which is to be retrofitted and which, due to the conditions of space on the spot is sufficient only for a limited exhaust-gas volume, is therefore not necessary.

In accordance with a further feature of the invention, there is provided a series connection of two high-pressure preheaters heated by flue gas and located upstream of the fired steam generator on the water/steam side. This is done in order to ensure that the residual heat still contained in the flue gas from the fired steam generator in the first part stream of exhaust gas from the gas turbine can be utilized as completely as possible. The entire feedwater supplied to the fired steam generator is preheated in a first high pressure preheater or boiler economizer, while only the first part stream of the feedwater is preheated in a second high-pressure preheater or part boiler economizer located downstream of the boiler economizer on the flue gas side.

The steam-turbine system can include one or more pressure stages. A two-pressure system with intermediate superheating and condensate preheating is expediently provided. Therefore, in accordance with an added feature of the invention, the waste-heat steam generator includes a condensate preheater, medium-pressure heating surfaces located upstream of the latter on the exhaust-gas side, an intermediate superheater, and advantageously high-pressure heating surfaces disposed at least partially parallel to these on the exhaust-gas side and connected in parallel on the water/ steam side. The intermediate superheater disposed in the waste-heat steam generator is connected in parallel to an expediently providedfurther intermediate superheater of the fired steam generator on the water/steam side.

In accordance with a concomitant feature of the invention, there is provided a feedwater tank, the preheaters including at least one preheater heated by steam from the steam turbine, and the fired steam generator communicating with the feedwater tank through the at least one preheater heated by steam from the steam turbine.

The advantages achieved through the use of the invention are, in particular, that as a result of the combination of a fired steam generator and a waste-heat steam generator, at the same time with a division of the exhaust gas from the gas turbine into part streams supplied to the steam generators, a wide range of fuels, for example coal, heavy oil, lean gases or special fuels, such as, for example, refuse, wood or waste oil can not only be used in the fired steam generator. On the contrary, in the case of a decreasing boiler capacity of the fired steam generator as a result of a fuel conversion from, for example, oil to coal or as a result of a conversion to firing low in nitric oxides, a particularly high steam turbine power and therefore a higher plant efficiency can nevertheless be maintained on account of the additional steam-generator power arising from the waste-heat steam generator.

Since the fired steam generator is loaded only with the exhaust gas from the gas turbine which is necessary for combustion, even under confined conditions of space the installation or retrofitting of a flue-gas purification system presents no problems, since the flue gas purification system has to be constructed only for a part stream of exhaust gas from the gas turbine and not for the entire exhaust-gas quantity. Furthermore, in the case of old plants with high power reserves of the steam turbine plant, these power reserves can be utilized through the additional steam production in the waste-heat steam generator.

Since the entire exhaust gases of the gas turbine are utilized virtually without loss, an especially high overall degree of utilization of the plant is achieved. In particular, if an older gas-turbine model is replaced by a modern assembly with a comparatively high waste-heat yield, this waste heat or excess residual heat can be utilized in the best possible way in the waste-heat steam generator.

Other features which are considered as characteristic for the invention are set forth in the appended claims.

Although the invention is illustrated and described herein as embodied in a method for operating a gas-turbine and steam-turbine plant and a plant working according to the method, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWING

The FIGURE of the drawing is a schematic and block circuit diagram of a combined gas-turbine and steam-turbine plant, with the gas turbine located downstream both of a fossil-fired steam generator and a waste-heat steam generator.

DESCRIPTION OF THE PREFERRED EMBODIMENTS

Referring now in detail to the single figure of the drawing, there is seen a gas-turbine and steam-turbine plant 1 which includes a gas-turbine plant that has a gas turbine 2 with a coupled air compressor 3 and a combustion chamber 4 which is located upstream of the gas turbine 2 and is connected to a fresh-air conduit 5 of the air compressor 3. A fuel or fuel gas conduit 6 opens into the combustion chamber 4 of the gas turbine 2. The gas turbine 2 and the air compressor 3 as well as a generator 7 are seated on a common shaft 8.

The gas-turbine and steam-turbine plant 1 further includes a steam-turbine plant with a steam turbine 10 having a coupled generator 11, as well as a condenser 13 located downstream of the steam turbine 10, a fired steam generator 14 and a waste-heat steam generator 15 in a water/steam circuit 12.

The steam turbine 10 is formed of a high-pressure part 10*a*, a medium-pressure part 10*b* as well as a low-pressure part 10*c* which drive the generator 11 through a common shaft 16.

In order to supply working medium or exhaust gas A expanded in the gas turbine 2 into the fired steam generator 14, a first part-stream conduit 18 is connected to an inlet 14*a* on the fired steam generator 14. A first part stream $t_1$ of the exhaust gas A from the gas turbine 2 is guided through the part-stream conduit 18. The first part stream $t_1$ has an oxygen content of approximately 15% and serves as combustion air during the combustion of a gaseous, liquid or solid fuel B. The fuel B is guided into the fired steam generator 14 through a fuel conduit 20 connected to an inlet 14*b* of the fired steam generator 14. In order to set the first part stream $t_1$, a control flap 22 is inserted into the part-stream conduit 18. Flue gas R occurring during the combustion of the fossil fuel B and the part stream $t_1$ of the exhaust gas A from the gas turbine 2 that serves as combustion air, leave the fired steam generator 14 through a flue-gas conduit 24 and after being purified in a purification system 26, travel in the direction of a non-illustrated chimney. The flue-gas purification system 26 includes non-illustrated flue-gas desulphurization, denitration ($DeNO_x$ system) and dedusting devices.

In order to supply a second part stream $t_2$ of exhaust gas A from the gas turbine 2 into the waste-heat steam generator 15, a second part-stream conduit 28 having a control flap 29 is connected to an inlet 15*a* of the waste-heat steam generator 15. The part stream $t_2$ of expanded exhaust gas A from the gas turbine 2 leaves the waste-heat steam generator 15 through its outlet 15*b* in the direction of the chimney.

The exhaust gas A from the gas turbine 2 which is required neither for the fired steam generator 14 nor for the waste-heat steam generator 15, is guided through a third part-stream conduit or bypass conduit 30 having a flap 32, for example during the run-up and run-down of the plant 1. In particular, however, this bypass conduit 30 serves for discharging the exhaust gas A from the gas turbine 2 when the latter is operated in the so-called single-cycle mode only.

A fresh-air conduit 34, into which a blower 36 and a steam-heated heat exchanger 38 as well as a flap 40 are inserted, opens into the part-stream conduit $t_1$. Fresh air KL, which is cold in comparison with the exhaust gas A from the gas turbine 2, can be admixed through this fresh-air conduit 34 with the part stream $t_1$ of exhaust gas A from the gas turbine 2.

The waste-heat steam generator 15 includes heating surfaces in the from of a preheater 42 having an inlet and an outlet, between which a circulating pump 44 is inserted. The preheater 42 is connected on the inlet side to an outlet of a condensate preheater 46 which is in turn connected on the inlet side through a condensate pump 48 to the condenser 13. The condensate preheater 46 is heated with steam through a tapping conduit 50 connected to the low-pressure part 10*c* of the steam turbine 10. Two preheaters 56 and 58 located downstream of the condensate preheater 46 and likewise heated through tapping conduits 52 and 54 connected to the low-pressure part 10*c*, are connected in parallel to the preheater 42 disposed in the waste-heat steam generator 15 and are connected on the outlet side to a feedwater tank 60.

The waste-heat steam generator 15 further includes heating surfaces in the form of a medium-pressure preheater or medium-pressure economizer 62 and a medium-pressure evaporator 64 as well as a medium-pressure superheater 66. The medium-pressure superheater 66 is connected on the outlet side to a steam conduit 68 connected to the high-pressure part 10*a* of the steam turbine 10, and to an intermediate superheater 70. The medium-pressure heating surfaces 62, 64, 66 are connected through the intermediate superheater 70 to a steam conduit 72 opening into the medium-pressure part 10*b* of the steam turbine 10. The medium-pressure heating surfaces 62, 64, 66 as well as the intermediate superheater 70 and the medium-pressure part 10*b* of the steam turbine 10 thus form a medium-pressure stage of the water/steam circuit 12.

The waste-heat steam generator 15 furthermore includes a high-pressure stage having heating surfaces in the form of two high-pressure preheaters or high-pressure economizers 74 and 75 connected in series as well as a high-pressure evaporator 76 and a high-pressure superheater 78. The high-pressure superheater 78 is connected on the outlet side through a steam conduit 80 to the inlet of the high-pressure part 10*a* of the steam turbine 10.

The medium-pressure economizer 62 and the high-pressure economizers 74, 75 within the waste-heat steam generator 15 are disposed in the region of an identical exhaust-gas temperature. However, the high-pressure evaporator 76 and the high-pressure superheater 78 are disposed upstream of the series connection of the medium-pressure evaporator 64 and the medium-pressure superheater 66, in the direction of flow of the part stream $t_2$ of exhaust gas A from the gas turbine 2. Additionally, the intermediate superheater 70 and the high-pressure superheater 78 are disposed in the region of an identical exhaust gas temperature.

The feedwater tank 60 is connected to the fired steam generator 14 through a high-pressure pump 82 and a heat-exchanger configuration having a series connection of three preheaters 84, 86, 88. Moreover, the feedwater tank 60 is connected through a medium-pressure pump 90 to the medium pressure economizer 62.

The pressure side of the high-pressure pump 82 is connected through a feedwater conduit 92 to a part-stream conduit 92*a* which is connected through a part boiler economizer 94 to the feedwater conduit 92 between the preheaters 86 and 88 and leads into the fired steam generator 14. Moreover, the feedwater conduit 92 is connected through a further part-stream conduit 92*b* to the high-pressure economizer 74. The part boiler economizer 94 and the preheater or boiler economizer 88 are inserted into the flue-gas conduit 24 of the fired steam generator 14.

The fired steam generator 14 is connected on the outlet side through a high-pressure superheater 96 to the inlet of the high-pressure part 10*a* of the steam turbine 10. The outlet side of the high-pressure superheater 96 is connected to the steam conduit 80. An intermediate superheater 98 is connected in parallel to the intermediate superheater 70 disposed in the waste-heat steam generator 15. The intermediate superheater 98 is connected on the inlet side through the steam conduit 68 to the outlet of the high pressure part 10*a* and on the outlet side to the medium pressure part 10*b* of the steam turbine 10. The preheaters 84 and 86 are heated through steam conduits 100 and 102 through the use of tapped steam from the medium-pressure part 10*b* and the high-pressure part 10*a* of the steam turbine 10.

When the combined gas-turbine and steam-turbine plant 1 is in operation, a fuel B' is supplied to the combustion chamber 4 of the gas turbine 2 through the fuel conduit 6 in a non-illustrated manner. The fuel B' is burnt in the combustion chamber 4 through the use of compressed fresh air L from the air compressor 3. Hot combustion gas V occurring during combustion is guided through a gas conduit 6*a* into the gas turbine 2. There, it expands and at the same time drives the gas turbine 2 which in turn drives the air compressor 3 and the generator 7. The hot exhaust gas A escaping from the gas turbine 2 is guided in the first part stream $t_1$ through the part-stream conduit 18 as combustion air leading into the fired steam generator 14. The second part stream $t_2$ of hot exhaust gas A from the gas turbine 2 is guided through the part-stream conduit 28 and through the waste-heat steam generator 15.

The hot flue gas R, which occurs during the combustion of the fossil fuel B as a result of the supply of the part stream $t_1$ of exhaust gas A from the gas turbine 2, serves for steam generation and subsequently leaves the fired steam turbine 14 through the flue-gas conduit 24 in the direction of the flue-gas purification system 26, after having been previously cooled first in the boiler economizer 88 and thereafter in the part boiler economizer 94 by heat exchange with feedwater from the feedwater tank 60.

The preheating of the feedwater takes place in three part streams $S_1$ to $S_3$. A first part stream $S_1$ of the feedwater which is under high pressure is adjustable through the use of a valve 104 inserted into the part-stream conduit 92*a*. Thus, the first part stream $S_1$ is guided through the part boiler economizer 94 and is preheated through the use of the flue gas R and the part stream $t_1$ of exhaust gas A of the gas turbine 2. A second part stream $S_2$ is adjustable through the use of a valve 106 inserted into the part-stream conduit 92*b*. The second part stream $S_2$ is guided through the high-pressure economizers 74 and 75 and is preheated by heat exchange with the second part stream $t_2$ of exhaust gas A from the gas turbine 2. The preheating of a third part stream $S_3$ of feedwater which is under high pressure and is adjustable through the use of a valve 108 inserted into the feedwater conduit 92, takes place in the preheaters 84 and 86 through the use of tapped steam from the steam turbine 10.

The preheating of the feedwater both for the fired steam generator 14 and for the waste-heat steam generator 15 thus takes place in each case in a multi-stage manner. At the same time, a two-stage preheating of the feedwater part stream $S_2$ takes place within the waste-heat steam generator 15 in the high pressure economizers 74 and 75 that are connected in series on the water/steam side. The feedwater for the fired steam generator 15 is preheated in three stages. In this case, the third part stream $S_3$ which is first preheated in a two-stage manner in the preheaters 84 and 86 is subsequently preheated, together with the part stream $S_1$ that is preheated in parallel in the part boiler economizer 94, in the boiler economizer 88 in the common third stage. This multi-stage preheating of the feedwater in three part streams $S_1$ to $S_3$ allows the particularly advantageous distribution or allocation of the feedwater to the two steam generators 14 and 15, so that an undesirable evaporation within their gas-heated preheaters 74, 75 and 88, 94 as a result of an increased introduction of heat from the part streams $t_1$ and $t_2$ of exhaust gas A from the gas turbine 2 as well as from the flue gas R, is virtually prevented, even when an especially high-power gas turbine 2 is used.

The steam generated in the waste-heat steam generator 15 in the high-pressure evaporator 76 and superheated in the high pressure superheater 78, is guided together with the steam generated in the fired steam generator 14 and superheated in the superheater 96, into the high-pressure part 10*a* of the steam turbine 10. The steam which is partially expanded in the high-pressure part 10*a* is superheated once again partially in the superheater 70 disposed in the waste-heat steam generator 15 and partially in the intermediate superheater 98 of the fired steam generator 14 and is subsequently supplied to the medium-pressure part 10*b* of the steam turbine 10. The steam which is further expanded in the medium-pressure part 10*b* is utilized partially for heating the feedwater in the feedwater tank 60 and partially for preheating the feedwater part stream $S_3$ guided through the preheater 84 and is guided partially directly into the low-pressure part 10*c* of the steam turbine 10. The steam which is expanded in the low-pressure part 10*c* is utilized through the tapping conduits 50 to 54 for the preheating of condensate K guided into the feedwater tank 60. The steam escaping from the low-pressure part 10*c* is condensed in the condenser 13 and is conveyed as condensate K through the condensate pump 48 and the preheaters 46, 56 and 58 into the feedwater tank 60. The water/steam circuit 12 that is common to the fired steam generator 14 and to the waste-heat steam generator 15 is thus closed.

We claim:

1. A method for operating a gas-turbine and steam-turbine plant, which comprises:

directing a first part stream of oxygenous exhaust gas from a gas turbine for use as combustion air for combustion of a fossil fuel for steam generation;

directing a second part stream of the exhaust gas from the gas turbine for use in waste-heat-steam generation;

performing the fossil fuel combustion steam generation and the waste-heat steam generation in a common water/steam circuit of a steam turbine;

preheating a first part stream of feedwater of the water/steam circuit with flue gas occurring during the combustion of the fossil fuel;

preheating a second part stream of the feedwater of the water/steam circuit with the second part stream of the exhaust gas from the gas turbine; and preheating a third part stream of the feedwater of the water/steam circuit with steam from the steam turbine.

2. The method according to claim 1, which comprises performing the preheating of the three part streams of feedwater in at least first and second stages, and preheating the first part stream and the third part stream in common in the second preheating stage with the flue gas occurring during the combustion of the fossil fuel.

3. The method according to claim 1, which comprises admixing a cold air stream with the first part stream of exhaust gas from the gas turbine as combustion air.

4. The method according to claim 1, which comprises purifying the first part stream of exhaust gas from the gas turbine serving as combustion air, together with the flue gas occurring during the combustion of the fossil fuel.

5. A gas-turbine and steam-turbine plant, comprising:

a gas turbine having an exhaust gas side;

first and second part-stream conduits connected to the exhaust gas side of said gas turbine;

a steam turbine;

a water/steam circuit connected to said steam turbine;

a fossil fired steam generator connected to said first part-stream conduit downstream of said gas turbine, said fired steam generator having a water/steam side connected into said water/steam circuit;

a waste-heat steam generator connected to said second part-stream conduit downstream of said gas turbine, said waste-heat steam generator connected parallel to said fired steam generator on the water/steam side; and a number of preheaters for multistage preheating of feedwater for said fired steam generator and for said waste-heat steam generator, said preheaters including a series connection of two boiler preheaters heated by flue gas and connected upstream of said fired steam generator on the water/steam side.

6. The gas-turbine and steam-turbine plant according to claim 5, including a flue-gas purification system connected downstream of said fired steam generator on a flue-gas side.

7. A gas-turbine and steam-turbine plant, comprising:

a gas turbine having an exhaust gas side;

first and second part-stream conduits connected to the exhaust gas side of said gas turbine;

a steam turbine;

a water/steam circuit connected to said steam turbine;

a fossil fired steam generator connected to said first part-stream conduit downstream of said gas turbine, said fired steam generator having a water/steam side connected into said water/steam circuit;

a waste-heat steam generator connected to said second part-stream conduit downstream of said gas turbine, said waste-heat steam generator connected parallel to said fired steam generator on the water/steam side, said waste-heat steam generator including:

condensate heating surfaces for condensate preheating;

medium-pressure heating surfaces disposed upstream of said condensate heating surfaces on the exhaust-gas side; and an intermediate superheater as well as high-pressure heating surfaces disposed at least partially parallel to said medium-pressure heating surfaces on the exhaust gas side and connected parallel to said medium-pressure heating surfaces on the water/steam side; and a number of preheaters for multistage preheating of feedwater for said fired steam generator and for said waste-heat steam generator.

8. The gas-turbine and steam-turbine plant according to claim 5, including a feedwater tank, said preheaters including at least one preheater heated by steam from said steam turbine, said fired steam generator communicating with said feedwater tank through said at least one preheater heated by steam from said steam turbine.

* * * * *